US006457751B1

(12) United States Patent
Hartman

(10) Patent No.: US 6,457,751 B1
(45) Date of Patent: Oct. 1, 2002

(54) LOCKING ASSEMBLY FOR AN ASTRAGAL

(76) Inventor: John F. Hartman, 1100 N. Johnson Ave., El Cajon, CA (US) 92020

( * ) Notice: Subject to any disclaimer, the term of this patent is extended or adjusted under 35 U.S.C. 154(b) by 0 days.

(21) Appl. No.: 09/765,133

(22) Filed: Jan. 18, 2001

(51) Int. Cl.[7] ..... E05C 1/04

(52) U.S. Cl. ..... 292/137; 292/150; 292/145; 292/152; 292/41; 49/366

(58) Field of Search ..... 292/145, 147, 292/150, 152, 137, 41, 42; 49/395, 366, 365

(56) References Cited

U.S. PATENT DOCUMENTS 2,710,216 A * 6/1955 Eichacker ..... 292/335
3,649,060 A * 3/1972 Ruff ..... 292/42
3,806,175 A * 4/1974 Van Herpen ..... 292/147
5,350,207 A * 9/1994 Sanders ..... 292/335
5,893,594 A * 4/1999 Zarzycki, Jr. ..... 292/346
D438,445 S * 3/2001 Monts de Oca ..... D8/331

* cited by examiner

*Primary Examiner*—Gary Estremsky
*Assistant Examiner*—Thomas Ho
(74) *Attorney, Agent, or Firm*—Charles C. Logan, II

(57) ABSTRACT

A locking assembly for an astragal that would be attached to the inactive door of a double door unit that would be installed in a residence or a building. The astragal would be attached to the edge of the inactive door in the space between the inactive door and the active door. A separate locking assembly would be attached adjacent the top end of the door and also adjacent the bottom end of the door. A plug having an elongated locking bolt extending from it is mounted in the front end of the carriage member. Additional structure is provided for reciprocal travel of the carriage member between a locked position and an unlocked position.

11 Claims, 6 Drawing Sheets

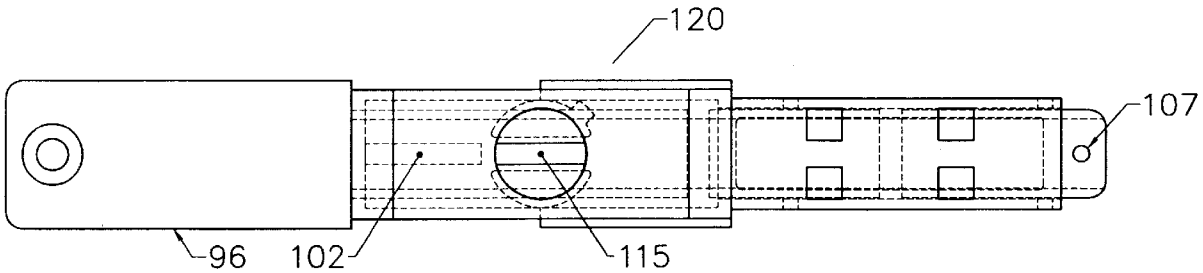
FIG. 20
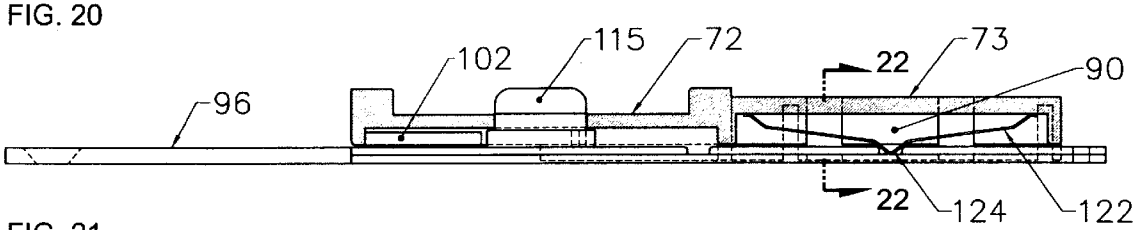
FIG. 21
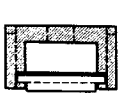
FIG. 22
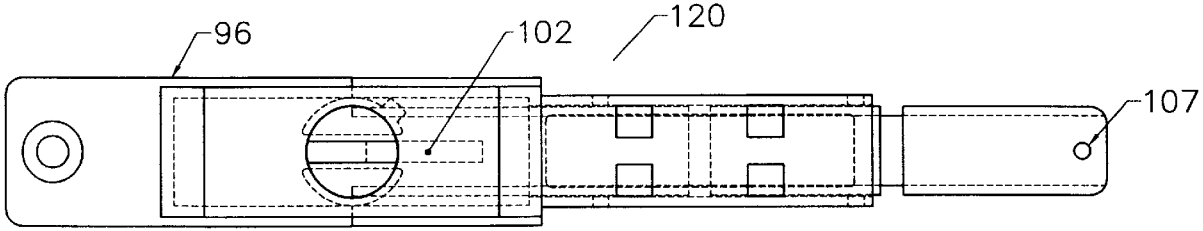
FIG. 23
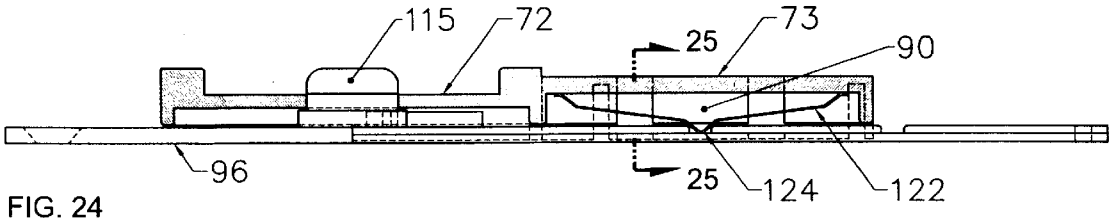
FIG. 24
FIG. 25

LOCKING ASSEMBLY FOR AN ASTRAGAL

BACKGROUND OF THE INVENTION

The invention relates to an astragal that would be attached to the inactive door of a double door unit that would be installed in a residence or a building, and more specifically to a locking assembly that would be installed in the astragal.

The use of locking assemblies in the prior art astragals is well known because the need to lock the inactive door when its use is not required. The prior art locking assemblies have not been entirely satisfactory since some of them are hard to grip the actuating member. Also it has been unnecessarily difficult to move the carriage assembly from its locked position with its locking bolt in full extension and its retracted position with its locking bolt completely disengaged. Often times it is hard to recognize the actuating structure for locking the carriage assembly in its extended position that prevents the inactive door from being opened.

It is an object of the invention to provide a novel locking assembly for an astragal that has a fingergrip flange that makes it easier to slide the carriage assembly upwardly and downwardly between its locked and unlocked position.

It is also an object of the invention to provide a novel locking assembly for an astragal that has a more visible lock actuating member that is quickly recognizable.

It is another object of the invention to provide a novel locking assembly for an astragal that has eliminated recesses around the lock actuating member in which people previously gripping the lock actuating member would catch their fingers.

It is an additional object of the invention to provide a novel locking assembly for an astragal that has structure for keeping the assembled lock body and index plate unit from popping apart during its insertion into the carriage member where when it is being removed therefrom It is a further object of the invention to provide a novel locking assembly for an astragal that provides an audible signal indicating when the locking bolt is in its extended locked position and its retracted unlocked position.

It is also an object of the invention to provide a novel locking assembly for an astragal that is easily and quickly installed in the carriage member of an astragal.

SUMMARY OF THE INVENTION

The astragal that would be attached to the inactive door of a double door unit is normally a length of extruded aluminum material having a carriage member channel formed therein. The carriage member channel is configured with inwardly extending grooves adjacent the bottom ends of its side walls for receiving flanges formed adjacent the bottom end of the side walls of the carriage member. A carriage assembly is inserted into the top end of the carriage member channel and also into the bottom end of the carriage channel. Each of these carriage assemblies would be secured to the carriage member channel at its proper height so that where respective upwardly and its downwardly extending bolt member would be fully retracted when the inactive door of a double door unit is required to be opened.

Once the carriage assemblies have been secured in their proper position in the carriage member channel, they are ready for operation. By gripping the fingergrip flange on the lock body and pulling it in the direction away from the center of the height of the astragal, the lock body that has been secured in the carriage member will push the carriage assembly to its extended position that fits the locking bolt of the carriage assembly into the locking bolt receptacle either in the door header or the threshold member. At this point the lock knob will have traveled past the end of the rail extending upwardly from the index plate that was previously secured to the carriage member channel of the astragal. As the carriage member reaches its extended position, the angular point of the leaf spring will have been captured in the cavity in the bottom end of the tongue portion of the lock body will snap into the extreme notch formed in the top of the index plate produced an audible clicking sound that will indicate that it is in its locked position. At this time the lock knob can be turned 90 degrees which would prevent retraction of the carriage assembly. In order to unlock the inactive door, the lock knob is rotated 90 degrees back to its original position and the finger flange extending up from the lock body is gripped and pulled in the direction of the retracted position. When the carriage assembly is fully retracted, the angular point of the leaf spring will drop into the notch on the top of the index plate and produce an audible click sound indicating that the bolt has been fully retracted.

DESCRIPTION OF THE DRAWINGS

FIG. 20 is a schematic top plan view of the assembled lock body and index plate unit showing it in its extended position;

FIG. 21 is a schematic vertical cross section of the assembled lock body and index plate unit;

FIG. 22 is a schematic cross sectional view taken along lines 22—22 of FIG. 21;

FIG. 23 is a schematic top plan view of the assembled lock body and index plate unit showing it in its retracted position;

FIG. 24 is a schematic vertical cross-section view of the assembled lock body and index plate unit; and FIG. 25 is a schematic cross sectional view taken along lines 25—25 of FIG. 24.

DESCRIPTION OF THE PREFERRED EMBODIMENT

Figure 1:
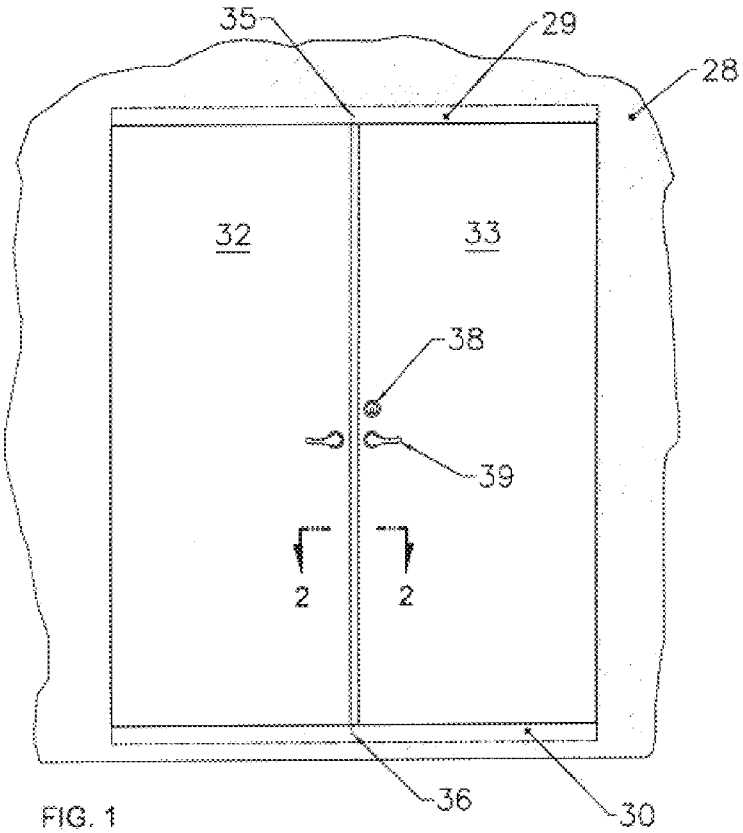
FIG. 1 is a front elevation view of a two door structure in a residence or a building.

The novel locking assembly for an astragal will now be described by referring to FIGS. 1–25 of the drawings. The environment in which the astragal is utilized is illustrated in FIG. 1. A wall 28 has an opening defined by a door header 29 and a threshold 30 into which is mounted an inactive door 32 and an active door 33. A locking bolt receptacle 35 is formed in door header 29 above inactive door 32. A locking bolt receptacle 36 is formed in threshold 30 below inactive door 32. A deadbolt 38 and a door handle 39 are installed in active door 33.

Figure 2:
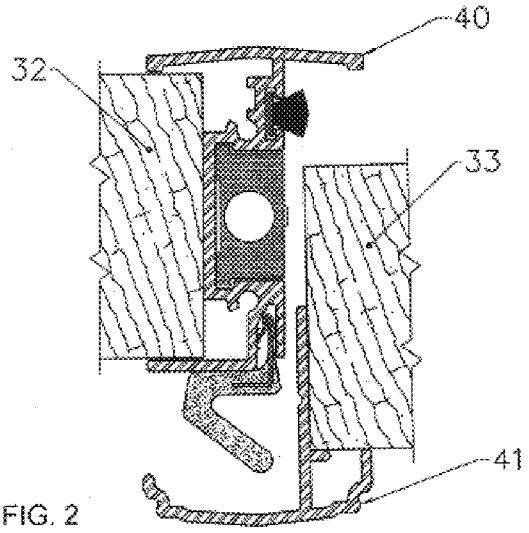
FIG. 2 is a schematic cross sectional view taken along lines 2—2 of FIG. 1.

FIG. 2 is a cross sectional view taken along lines 2—2 of FIG. 1. An extruded astragal 40 is installed on the right vertical edge of inactive door 32. A security shield 41 is installed on the front vertical edge of active door 33.

Figure 3:
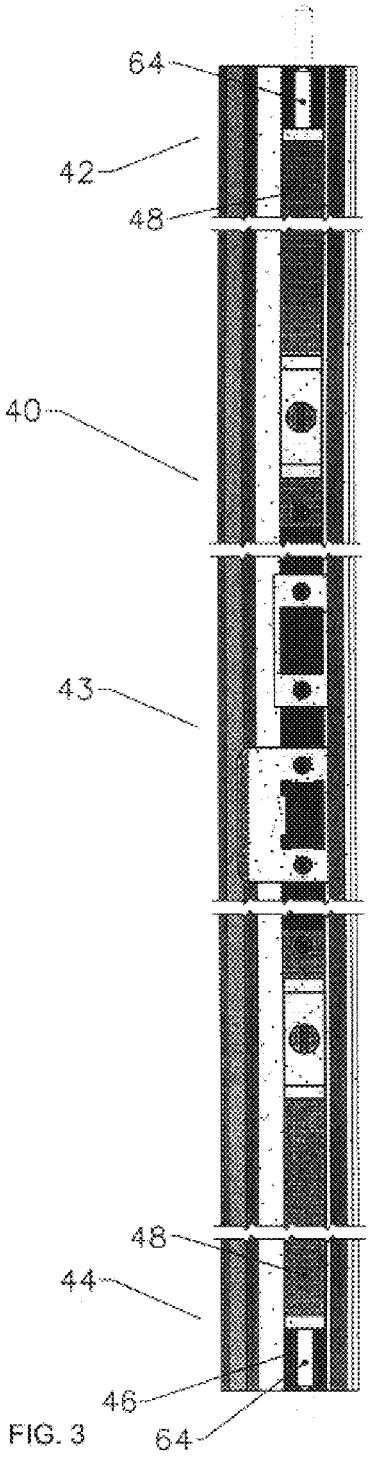
FIG. 3 is a schematic front elevation view of the astragal.
Figure 4:
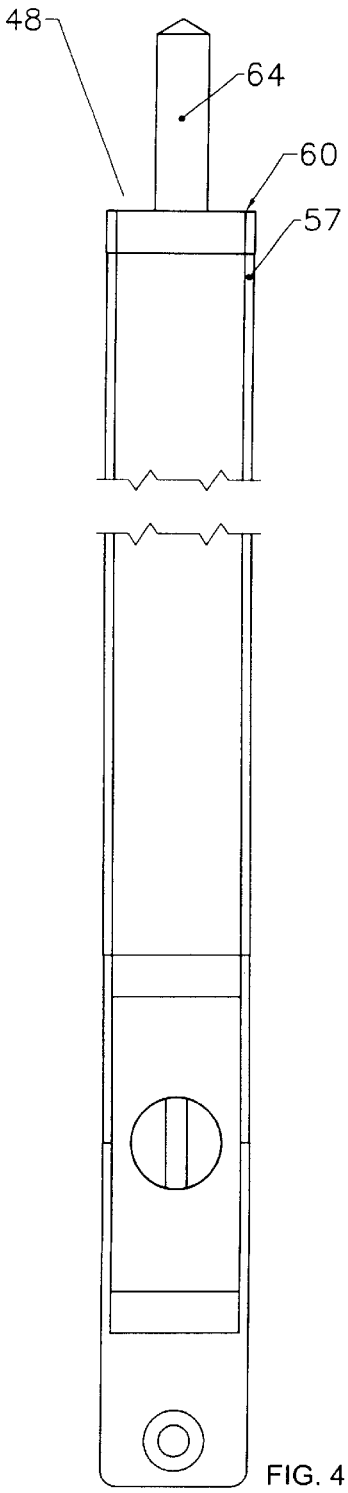
FIG. 4 is a front elevation view of the carriage assembly.
Figure 5:
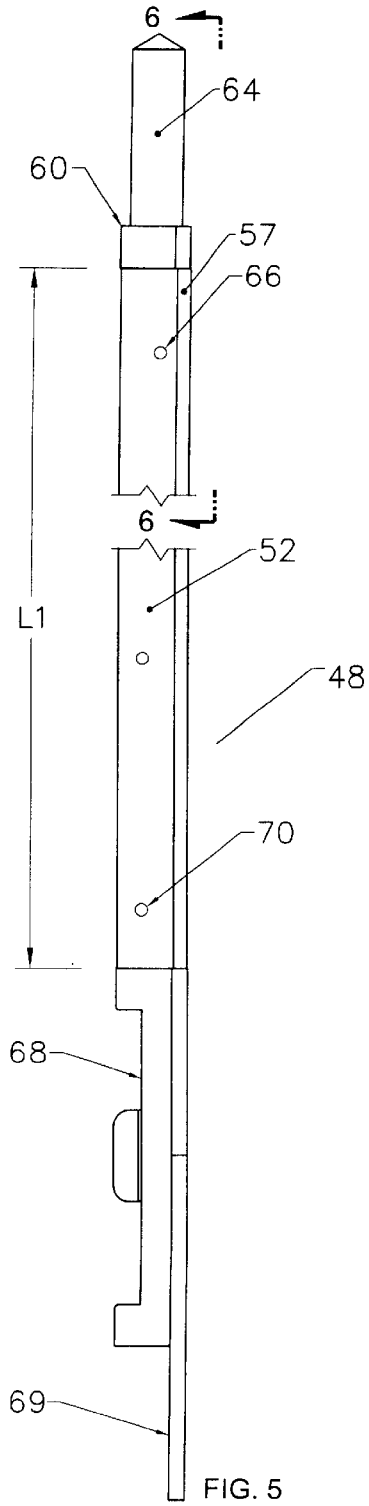
FIG. 5 is a side elevation view of the carriage assembly.
Figure 6:
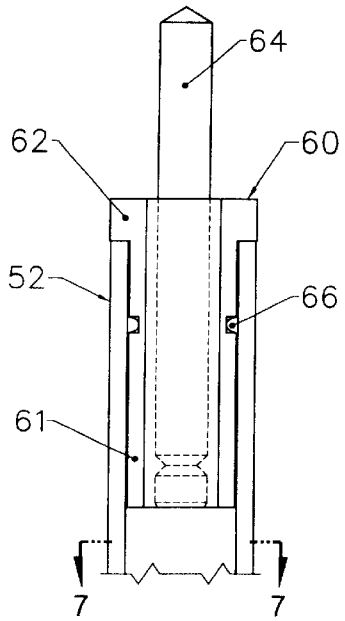
FIG. 6 is a rear elevation view of the top end of the carriage assembly.
Figure 7:
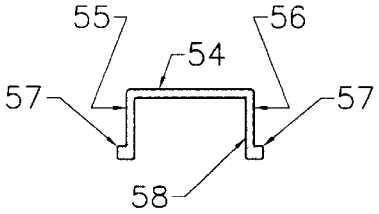
FIG. 7 is a cross sectional view taken along lines 7—7 of FIG. 6.
Figure 10:
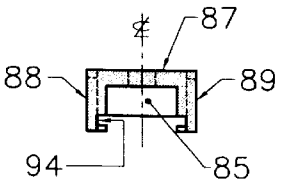
FIG. 10 is a cross sectional view taken along lines 10—10 of FIG. 9.
Figure 8:
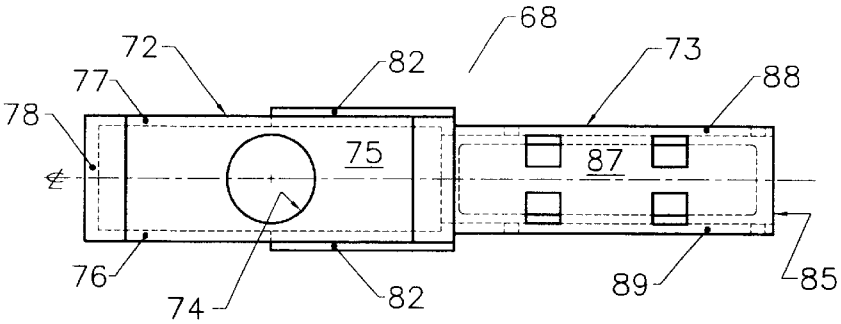
FIG. 8 is a top plan view of the lock body.
Figure 9:
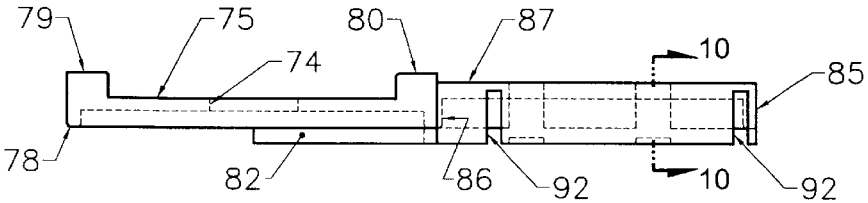
FIG. 9 is a side elevation of the lock body.
Figure 11:
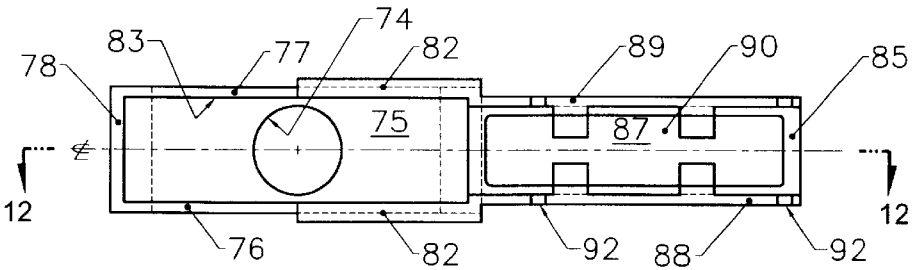
FIG. 11 is a bottom plan view of the lock body.
Figure 12:
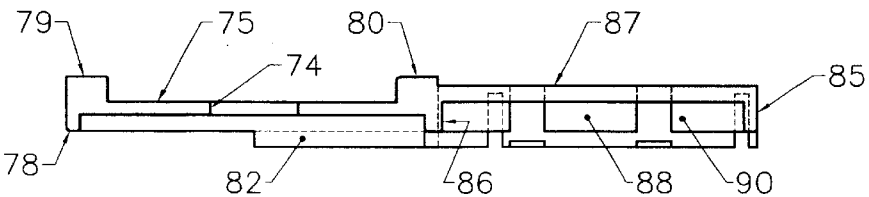
FIG. 12 is a vertical cross sectional view taken along lines 12—12 of FIG. 8.

The astragal 40 that extends from the top end of inactive door 32 to its bottom end is illustrated in FIG. 3. It has a top end portion 42, a middle portion 43 and a bottom end portion 44. A carriage member channel 46 extends the entire length of astragal 40. A carriage assembly 48 is telescopically received in both the top end portion 42 and the bottom end portion 44. A door latch and deadbolt receptacle zone lies between the respective carriage assemblies 48.

The structure of the carriage assembly is best described by referring to FIGS. 4–7 of the drawings. Carriage assembly 48 has an elongated carriage member 52 having a top wall 54, a left side wall 55, a right side wall 56, flanges 57 and a channel-shaped groove 58 formed in its bottom end. Installed in the top end of carriage member 52 is a plug 60 having a shank portion 61 and a shoulder 62. A bolt 64 extends from the front end of carriage members 52 and in their locked position are received in the respective locking bolt receptacles 35 and 36. Shank portion 61 is secured to carriage member 52 by staking indents 66 in side walls 55 and 56. Carriage member 52 has a length L1 in the range of 8–18 inches. A lock body 68 is connected to index plate 69 and they are telescopically received in the channel-shaped groove 58 of carriage member 52. They are held together in an assembled state by staked indents 70 in the respective side walls 55 and 56.

The structure of lock body 68 is best illustrated and described by referring to FIGS. 8–12. Lock body 68 has a base portion 72 and a tongue portion 73. Base portion 72 has a top wall/deck 75 having a circular aperture 74. It also has a left side wall 76, a right side wall 77 and a rear wall 78. A fingergrip flange 79 extends upwardly from the rear end of top wall 75 and a shoulder 80 extends upwardly from the front end of top wall 75. Flanges 82 extend outwardly from the respective side walls 76 and 77. A chamber 83 is formed in the bottom of base portion 72. Tongue portion 73 has a front wall 85, a rear wall 86, a top wall 87, a left side wall 88, a right side wall 89 and together they form a cavity 90 in the bottom of tongue portion 73. Slots 92 are formed in the respective side walls 88 and 89. Grooves 94 are formed along the bottom edge of the inner surface of the respective side walls 88 and 89 for telescopically receiving fingers on the front end of index plate 69.

Figure 13:
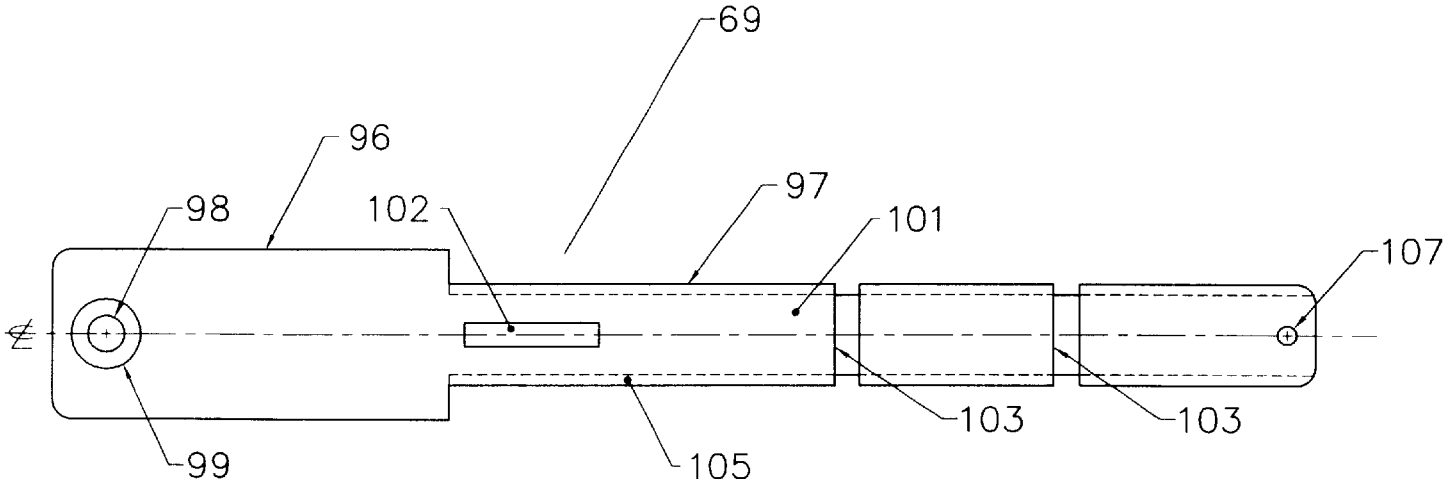
FIG. 13 is a top plan view of the index plate.
Figure 15:
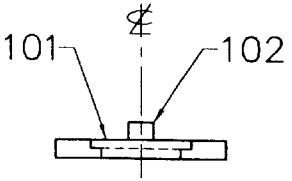
FIG. 15 is a front end view of the index plate.
Figure 14:
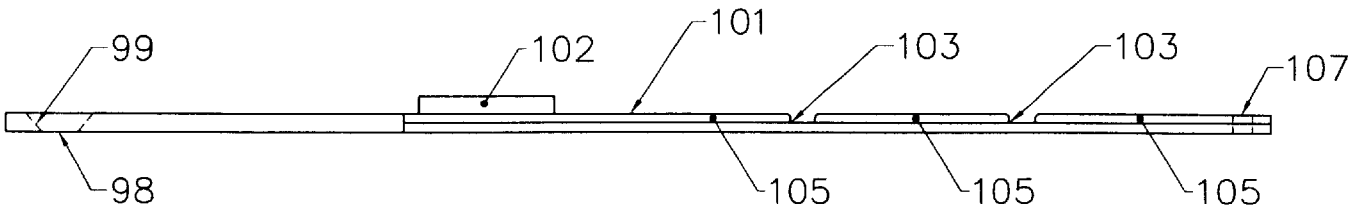
FIG. 14 is a side elevation view of the index plate.
Figure 16:
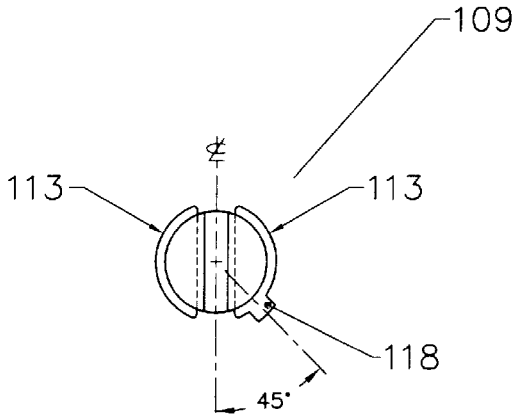
FIG. 16 is a top plan view of the lock knob.
Figure 17:
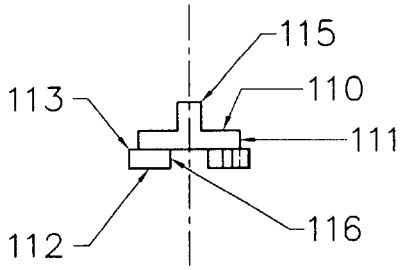
FIG. 17 is a front elevation view of the lock knob.
Figure 18:
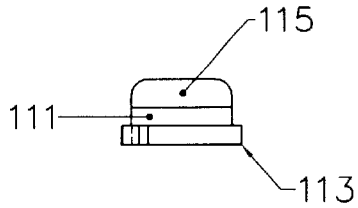
FIG. 18 is a side elevation view of the lock knob.
Figure 19:
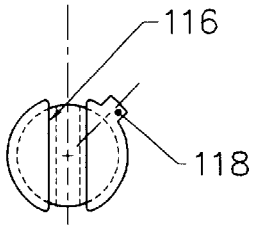
FIG. 19 is a bottom plan view of the lock knob.

Referring to FIGS. 13–15, the structure of index plate 69 will now be described. Index plate 69 has a body portion 96 and a neck portion 97. A bore hole 98 having a beveled top surface 99 is formed in body portion 96 for receiving a flat headed bolt that would attach index plate 69 in the carriage member channel 46 of astragal 40. Neck portion 97 has a top surface 101 having an upwardly extending rail 102. A pair of longitudinally spaced notches 103 extend transversely across neck portion 97. Upper flanges 105 extend outwardly from the left and right edges of top surface 101 and they are telescopically received in grooves 94 of lock body 68. A bore hole 107 is formed adjacent the front end of neck portion 97 for receiving a travel limit pin (not shown).

Lock knob 109 is best illustrated in FIGS. 16–19. It has a top surface 110, a side wall 111, a bottom surface 112 and a pair of arcuately shaped flanges 113. A finger gripping ridge 115 extends upwardly from top surface 110. A channel 116 is formed between the arcuately shaped flanges 113. A finger 118 extends radially outward from one of the arcuately shaped flanges 113.

Referring to FIGS. 20–25, the manner in which the lock body 68, the index plate 69 and the lock knob 109 are assembled together will be more easily understood. FIGS. 20 and 21 show the assembled lock body and index plate unit 120 in its extended position and FIGS. 23 and 24 show it in its retracted position. Lock knob 109 is shown captured in circular aperture 76 with its channel 116 aligned with rail 102. Upper flanges 105 of index plate 69 are shown captured in the grooves 94 of the tongue portion 73 of lock body 68. A leaf spring 122 has its opposite ends captured in cavity 90 of tongue portion 73. Leaf spring 122 has an angular point 124 that is captured in the respective front and rear notches 103 of index plate 69 and as it snaps therein it makes an audible click noise. When angular point 124 is captured in the forward notch 103, the forward travel of lock body 68 with respect to the index plate unit 120 is restricted. When angular point 124 is captured in the rearward notch 103, the rearward travel of lock body 68 with respect to the index plate unit 120 is restricted. This occurs when the carriage member 52 is made to travel axially with respect to index plate 69 as locking bolt 64 is moved from its extending position to its retracted position.

What is claimed is:

1. A locking assembly for an astragal comprising:

an elongated carriage assembly having a carriage member having a front end, a rear end, a top wall, a left side wall, a right side wall, and a bottom surface; a channel-shaped groove formed in said bottom surface and extending from said front end to said rear end; said left and right side walls each having an outer surface from which extends a flange that would telescopically mate with grooves formed in the carriage member channel of an extruded astragal;

a plug having a front end and a rear end; an elongated locking bolt extending from said front end of said plug; said plug being telescopically received in said front end of said carriage member; and means rigidly attaching said plug to said carriage member;

an elongated lock body comprising a base portion having a front end and a rear end; a tongue portion having a front end and a rear end; and said rear end of said tongue portion being connected to said front end of said base portion; said base portion having a left side wall, a right side wall, and a rear wall each having a top edge; a top wall extends between said top edges of said rear wall, said left side wall and said right side wall and forms a chamber under said top wall; a circular aperture is formed in said top wall; said tongue portion having a front wall, a rear wall, a left side wall, a right side wall and a top wall that all have an inner surface and form a cavity beneath said top wall; said tongue portion being telescopically received in said rear end of said carriage member and fixedly attached to said carriage member;

an elongated index plate comprising a body portion having a front end and a rear end; a neck portion having a front end, a rear end and said rear end of said neck portion being connected to said front end of said body portion; said neck portion having a top surface having a left edge and a right edge that form outwardly extending upper flanges that are telescopically mated with grooves on the inner surfaces of said left and right side wall of said tongue portion of said lock body; a longitudinally extending rail extends upwardly from said top surface of said neck portion adjacent its rear end;

said elongated index plate being telescopically received in said channel-shaped groove formed in said bottom surface of said carriage member; and means for rigidly connecting said body portion of said index plate to a carriage member channel of an extruded astiagal; and a lock knob having a top surface, a circular side wall, and a bottom surface; a longitudinally extending fingergripping ridge extends upwardly from said top surface; said bottom surface having a longitudinally extending channel formed therein and a pair of arcuately shaped flanges extend radially outward from said bottom surface; said lock knob being rotatably received in said circular aperture in said base portion of said lock body; said channel in said bottom surface of said lock knob being aligned with said rail extending upwardly from said top surface of said neck portion of said index plate.

2. A locking assembly as recited in claim 1 further comprising means for limiting rearward axial travel of said lock body with respect to said index plate.

3. A locking assembly as recited in claim 1 further comprising means for limiting forward axial travel of said lock body with respect to said index plate.

4. A locking assembly as recited in claim 1 further comprising signal means for providing an audio signal when said bolt at said front end of said plug has advanced to its forward locking position and when said front end of said bolt has been retracted to its unlocked position.

5. A locking assembly as recited in claim 4 wherein said signal means comprises a pair of longitudinally spaced notches in said top surface of said neck portion of said index plate; a leaf spring having a front end, a rear end, and an intermediate angular point has its opposite ends captured in said cavity in the bottom of said tongue portion of said lock body and as said lock body is moved forwardly and rearwardly said angular point of said leaf spring will snap into the respective notches formed in said top surface of said neck portion of said index plate resulting in an audio click sound.

6. A locking assembly as recited in claim 1 further comprising a finger extending radially outward from one of said arcuately shaped flanges of said lock knob for limiting rotation of said lock knob.

7. A locking assembly as recited in claim 1 wherein said lock knob is made of red material that aids in identifying said lock knob.

8. A locking assembly as recited in claim 1 wherein said top surface of said lock knob is substantially parallel with said top surface of said top wall of said lock body.

9. A locking assembly as recited in claim 1 wherein said means for rigidly connecting said body portion of said index plate to a carriage member of an extruded astragal comprises a bore hole having a beveled top surface in said body portion of said index plate and a flat headed bolt whose head is flush with said top surface of said body portion.

10. A locking assembly as recited in claim 1 further comprising a fingergrip flange extending upwardly from said rear end of said top wall of said base portion of said lock body.

11. A locking assembly as recited in claim 1 wherein said front end and rear end of said finger gripping ridge of said lock knob are rounded.

* * * * *